US005326485A

United States Patent [19]

Cervenka et al.

[11] Patent Number: 5,326,485

[45] Date of Patent: Jul. 5, 1994

[54] LOW ASH LUBRICATING OIL COMPOSITIONS

[75] Inventors: Michelle M. Cervenka, Belleville, Ill.; Marsha J. Lester, St. Louis, Mo.

[73] Assignee: Ethyl Petroleum Additives, Inc., Richmond, Va.

[21] Appl. No.: 119,454

[22] Filed: Sep. 10, 1993

Related U.S. Application Data

[63] Continuation of Ser. No. 825,603, Jan. 24, 1992, abandoned.

[51] Int. Cl.[5] ..... C10M 137/06

[52] U.S. Cl. ..... 252/32.7 E; 252/18; 252/33; 252/50; 252/52 R

[58] Field of Search ..... 252/32.7 E, 18

[56] References Cited

U.S. PATENT DOCUMENTS

| | | | |
|---|---|---|---|
| 4,264,458 | 4/1981 | Campbell et al. | 252/32.7 E |
| 4,466,894 | 8/1984 | Grover | 252/32.7 E |
| 4,495,075 | 1/1985 | Buckley | 252/32.7 E |
| 4,528,108 | 7/1985 | Grover | 252/75 |
| 4,592,851 | 6/1986 | Stadtmiller et al. | 252/32.7 E |
| 4,681,694 | 7/1987 | Zoleski et al. | 252/32.7 E |
| 4,704,217 | 11/1987 | Sweeney et al. | 252/32.7 E |

FOREIGN PATENT DOCUMENTS

| | | |
|---|---|---|
| 0277729 | 8/1988 | European Pat. Off. . |
| 0393768 | 10/1990 | European Pat. Off. . |
| 0447916 | 9/1991 | European Pat. Off. . |
| 9004626 | 5/1990 | PCT Int'l Appl. . |

*Primary Examiner*—Ellen M. McAvoy
*Attorney, Agent, or Firm*—John F. Sieberth

[57] ABSTRACT

Lubricant and functional fluids, and additive concentrates, are composed of a) at least one overbased zinc dialkyldithiophosphate characterized in that (i) each of the alkyl groups is a primary alkyl group containing from 6 to 10 carbon atoms, (ii) the overbased to neutral ratio of the dithiophosphate is 0.96 or above as determined by $^{31}P$ nmr, (iii) the integrated $^{31}P$ nmr spectrum of the dithiophosphate shows less than about 0.25 area percent phosphorus at about 80 ppm, (iv) the integrated $^{31}P$ nmr spectrum of the dithiophosphate shows essentially no phosphate species at about 5 to about 15 ppm, and (v) the dithiophosphate exhibits a copper weight loss in ASTM Test Method D2619 of 0.70 maximum; b) at least one hindered phenolic antioxidant or at least one aromatic secondary amine antioxidant; and c) at least one overbased alkaline earth metal sulfurized alkyl phenate having a TBN as determined by ASTM Test Method D2896 of at least 200 or at least one alkaline earth metal alkyl aromatic sulfonate. Preferred zinc dithiophosphates are further characterized in that the integrated $^{31}P$ nmr spectrum of the dithiophosphate shows essentially no phosphorus species at about 95 to about 98 ppm. High thermal and oxidative ability is achieved.

25 Claims, No Drawings

LOW ASH LUBRICATING OIL COMPOSITIONS

This is a continuation of copending application Ser. No. 07/825,603 filed on Jan. 24, 1992, now abandoned.

TECHNICAL FIELD

This invention relates to low ash antiwear additive compositions and lubricating oils containing them.

BACKGROUND

Additive compositions based on zinc dihydrocarbyl dithiophosphates have been extensively used in the past. However the performance capabilities of prior low ash additive compositions based on zinc dihydrocarbyl dithiophosphates can vary to a considerable extent.

A need has arisen for a low ash antiwear additive composition which exhibits high thermal and oxidative stability even when used at very low treat levels in lubricating oil base stocks. This invention is deemed to fulfill this need in an effective and economical manner.

THE INVENTION

This invention involves, inter alia, the discovery that it is possible to provide low ash lubricating oil additive compositions that possess high thermal and oxidative stability by employing certain specified types of zinc dialkyl dithiophosphates and by utilizing them in combination with certain types of auxiliary additive components.

In one of its embodiments this invention provides an additive concentrate suitable for addition to oil-based lubricants and functional fluid compositions, the additive concentrate comprising a minor amount of liquid inert diluent and a major amount of the following combination of components:

a) at least one overbased zinc dialkyl dithiophosphate characterized in that (i) each of the alkyl groups is a primary alkyl group containing from 6 to 10 carbon atoms, preferably 8 carbon atoms, (ii) the overbased to neutral ratio of the dithiophosphate is 0.96 or above as determined by $^{31}P$ nmr, (iii) the integrated $^{31}P$ nmr spectrum of the dithiophosphate shows less than about 0.25 area percent phosphorus at about 80 ppm, (iv) the integrated $^{31}P$ nmr spectrum of the dithiophosphate shows essentially no phosphate impurity at about 5 to about 15 ppm, and (v) the dithiophosphate exhibits a copper weight loss in ASTM Test Method D2619 of 0.70 maximum;

b) (i) at least one oil-soluble hindered phenolic antioxidant or (ii) at least one oil-soluble aromatic secondary amine, or preferably, a combination of (i) and (ii); and c) (i) at least one overbased alkaline earth metal (most preferably, calcium) sulfurized alkyl phenate having a TBN as determined by ASTM Test Method D2896 of at least 200 or (ii) at least one alkaline earth metal (most preferably, calcium) alkyl aromatic sulfonate, or preferably, a combination of (i) and (ii).

Additive concentrates used for power transmission applications such as hydraulic fluids preferably contain at least one additional component, namely:

d) at least one demulsifying agent and/or e) at least one antirust additive.

Most preferably a combination of components d) and e) is used in such compositions.

Lubricant and functional fluid compositions comprising a major amount of base oil of lubricating viscosity and minor amounts of components a), b), and c), and preferably d) and/or e) above as well, constitute additional embodiments of this invention. Still other embodiments will be apparent from the following description and appended claims.

In order to assay the overbased to neutral ratio of the zinc dialkyl dithiophosphate, conventional $^{31}P$ nmr procedures are employed. In accordance with these procedures, overbased species appear in the range of about 103 to about 105 ppm in the nmr spectrum whereas neutral species appear in the range of about 100 to about 102 ppm and the signals are integrated in the usual manner to calculate the overbased : neutral ratio. Preferably, component a) is still further characterized by producing an integrated $^{31}P$ nmr spectrum that shows the essential absence (e.g., a trace at most) of any species at about 95 to about 98 ppm. A particularly preferred material for use as component a) is a zinc di-(2-ethyl-1-hexyl) dithiophosphate that meets each of the foregoing specifications.

Hindered phenolic antioxidants such as a mixture of tertiary butyl phenols containing at least about 75% and preferably at leas about 85% 2,6-di-tert-butylphenol, such as Ethyl® 735 antioxidant, constitute one preferred type of antioxidant for use in the compositions of this invention. Other suitable hindered phenolic antioxidants include 2,6-di-tert-butylphenol, 4-methyl-2,6-di-tert-butylphenol, 2,4,6-tri-tert-butylphenol, 2-tert-butylphenol, 2,6-diisopropylphenol, 2-methyl-6-tert-butylphenol, 2,4-dimethyl-6-tert-butylphenol, 4-(N,N-dimethylaminomethyl)-2,6-di-tert-butylphenol, 4-ethyl-2,6-di-tert-butylphenol, 2-methyl-6-styrylphenol, 2,6-distyryl-4-nonylphenol, and their analogs and homologs. Mixtures of two or more such mononuclear phenolic compounds are also suitable.

Also useful in the compositions of this invention are methylene-bridged alkylphenols, and these can be used singly or in combinations with each other, or in combinations with sterically-hindered unbridged phenolic compounds. Illustrative hindered methylene bridged compounds include 4,4'-methylenebis(6-tert-butyl-o-cresol), 4,4'-methylenebis(2-tert-amyl-o-cresol), 2,2'-methylene-bis(4-methyl-6-tert-butylphenol), 4,4'-methylenebis(2,6-di-tert-butylphenol), and similar compounds. Also useful are mixtures of methylenebridged alkylphenols such as are described in U.S. Pat. No. 3,211,652, all disclosure of which is incorporated herein by reference.

Oil-soluble secondary aromatic amine antioxidants which can be used in the compositions of this invention include such compounds as diphenylamine, alkyl diphenylamines containing 1 or 2 alkyl substituents each having up to about 16 carbon atoms, phenyl-$\alpha$-naphthylamine, phenyl-$\beta$-naphthylamine, alkyl- or aralkyl- substituted phenyl-$\alpha$-naphthylamine containing one or two alkyl or aralkyl groups each having up to about 16 carbon atoms, alkyl- or aralkyl-substituted phenyl-$\beta$-naphthylamine containing one or two alkyl or aralkyl groups each having up to about 16 carbon atoms, N,N'-dialkyl-o-phenylene diamines, N,N'-dialkyl-m-phenylene diamines, N,N'-dialkyl-p-phenylene diamines, 4-alkylaminodiphenylamines, and similar compounds. A preferred type of aromatic amine antioxidant is an alkylated diphenylamine of the general formula

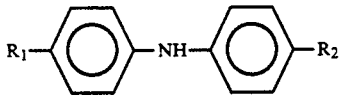

wherein $R_1$ is an alkyl group (preferably a branched alkyl group) having 8 to 12 carbon atoms, (more preferably 8 or 9 carbon atoms) and $R_2$ is a hydrogen atom or an alkyl group (preferably a branched alkyl group) having 8 to 12 carbon atoms, (more preferably 8 or 9 carbon atoms). Most preferably, $R_1$ and $R_2$ are the same. One such preferred compound is available commercially as Naugalube 438L, a material which is understood to be predominately a 4,4'-dinonyldiphenylamine (i.e., bis(4-nonylphenyl)amine) wherein the non groups are branched.

As noted above, it is preferable to use a combination of at least one oil-soluble hindered phenol antioxidant and at least one oil-soluble aromatic secondary amine antioxidant. When using such combinations, the proportions of the phenolic antioxidant to the aromatic amine antioxidant are preferably in the range of about 3-14 parts by weight of the phenolic antioxidant per part by weight of the amine antioxidant. Preferred proportions are in the range of about 5 to about 10 parts by weight, and more preferably about 6 to about 8 parts by weight, of the phenolic antioxidant per part by weight of the amine.

The one or more overbased alkaline earth metal sulfurized alkyl phenates that can be and preferably are used in the compositions of this invention are those having a TBN (ASTM D2896) of over 200, most preferably a sulfurized calcium alkyl phenate with a TBN of at least about 250, such as OLOA 219, Chevron Chemical Company. Products with a TBN as high as 400 or more can be used. Overbased magnesium, strontium or barium sulfurized alkylphenates can also be used either singly or in various two- or three-component combination with each other; and/or in combination with one or more over-based calcium sulfurized alkyl phenates. Overbased alkaline earth metal salicylates can also be used either in lieu of or in addition to one or more overbased alkaline earth metal sulfurized alkyl phenates.

The compositions can and preferably do contain one or more alkaline earth alkylaromatic sulfonates, more preferably one or more dihydrocarbyl naphthalene sulfonates, most preferably a calcium dialkyl naphthalene sulfonate wherein the alkyl groups each contain 6 to 12 carbon atoms, most preferably 9 carbon atoms, such as NA-SUL ® 729 inhibitor. The alkaline earth metal can be magnesium, strontium, barium or calcium, and most preferably, calcium salts are employed. Mixtures of sulfonates of various alkaline earth metals can also be used.

It is preferable, as pointed out above, to use a combination of one or more overbased alkaline earth metal sulfurized alkyl phenates and one or more alkaline earth alkylaromatic sulfonates. When using such combinations, the proportions of the overbased alkaline earth metal sulfurized alkyl phenate(s) to the alkaline earth alkylaromatic sulfonate(s) are preferably in the range of about 1 to about 4 parts by weight of the phenate(s) per part by weight of the sulfonate(s). Preferred proportions are in the range of about 2 to about 3.5 parts by weight, and more preferably about 2 to about 2.5 parts by weight, of the phenate(s) per part by weight of the sulfonate(s).

Demulsifier(s) which can be used in the compositions of this invention can likewise be varied. The preferred materials for the use are, however, liquid nonionic surface active agents, such as the amine glycol condensates such as are available under the TRITON trademark of Rohm & Haas Company. A particularly preferred material of this type is TRITON CF-32 which is described by the manufacturer as composed of 95% active component(s) and 5% water which is a pale yellow liquid having a Brookfield viscosity at 25° C. of 550 cP, a specific gravity of 1.03 at 25° C., a density of 8.6 lb/gal, a pH (5% aqueous solution) of 9.5-11, a flash point (TOC) of <300° F., and a pour point of 15° F. (−9° C.).

Examples of other demulsifiers which can be used include alkyl benzene sulphonates, polyethylene oxides, polypropylene oxides, block copolymers of ethylene oxide and propylene oxide, salts and esters or oil soluble acids, and the like.

Thus, for example use can be made of oxyalkylated trimethylol alkanes with molecular weights in the range of 1,000 to 10,000, and preferably in the range of 3,000 to 8,000. Preferably, the oxyalkylated trimethylol alkane is an oxyalkylated trimethylol ethane or propane, especially where the oxyalkylene groups are composed of a mixture of propyleneoxy and ethylenoxy groups and where these groups are so disposed as to form relatively hydrophobic blocks adjacent the trimethylol group and relatively hydrophilic blocks remote the trimethylol group. Typical oxyalkylated trimethylol propane demulsifiers are described in U.S. Pat. No. 3,101,374. Commercially available products of this type are available from BASF Corporation under the Pluradot trademark. They are available in various molecular weights. Pluradot HA-510 has an average molecular weight of 4,600 and Pluradot HA-530 has an average molecular weight of about 5,300. Pluradot additives are propoxylated and ethoxylated trimethylol propanes.

Another type of suitable demulsifers are oxyalkylated alkyl phenol-formaldehyde condensation products. Typically, these products have molecular weights in the range of about 4,000 to about 6,000 and are comprised of lower alkyl substituted phenol moieties joined together by methylene groups and in which the hydroxyl groups of the phenolic moieties have been ethoxylated. One such commercial product is marketed by Ceca S.A. of Paris, France under the "Prochinor GR77" trade name. The product is supplied as a concentrate in an aromatic solvent and the active ingredient is believed to be an ethoxylated nonylphenol-formaldehyde condensate of molecular weight 4,200 (by gel permeation chromatography calibrated with polystyrene).

Another suitable type of demulsifier is comprised of the tetra-polyoxyalkylene derivatives of ethylene diamine, especially the tetra-poly(oxyethylene)-poly(oxypropylene) derivatives of ethylene diamine. Materials of this type are available commercially from BASF Corporation under the "Tetronics" trademark. Materials of this general type are described in U.S. Pat. No. 2,979,528.

Mixtures of alkylaryl sulphonates, polyoxyalkylene glycols and oxyalkylated alkylphenolic resins, such as are available commercially from Petrolite Corporation under the TOLAD trademark, are also suitable. One such proprietary product, identified as TOLAD 286K, is understood to be a mixture of these components dissolved in a solvent composed of alkyl benzenes.

TOLAD 286 is believed to be a similar product wherein the solvent is composed of a mixture of heavy aromatic naphtha and isopropyl alcohol.

Also useful as demulsifiers are proprietary materials available from BASF Corporation under the Pluronic and Pluradyne trademarks. These are believed to be block copolymers of propylene oxide and ethylene oxide.

For some applications the compositions of this invention preferably contain a rust inhibitor. Various types of rust inhibitors are suitable for use in the compositions of this invention. These include dimer and trimer acids, such as are produced from tall oil fatty acids, oleic acid, linoleic acid, or the like. Products of this type are currently available from various commercial sources, such as, for example, the dimer and trimer acids sold under the HYSTRENE trademark by the Humco Chemical Division of Witco Chemical Corporation and under the EMPOL trademark by Emery Chemicals. Another useful type of rust inhibitor for use in the practice of this invention are the alkenyl succinic acid and alkenyl succinic anhydride corrosion inhibitors such as, for example, tetrapropenylsuccinic acid, tetrapropenylsuccinic anhydride, tetradecenylsuccinic acid, tetradecenylsuccinic anhydride, hexadecenylsuccinic acid, hexadecenylsuccinic anhydride, and the like. Also useful are the half esters of alkenyl succinic acids having 8 to 24 carbon atoms in the alkenyl group with alcohols such as the polyglycols. Other suitable corrosion inhibitors include ether amines; acid phosphates; amines; polyethoxylated compounds such as ethoxylated amines, ethoxylated phenols, and ethoxylated alcohols; imidazolines; modified imidazolines; and the like. Materials of these types are well known to those skilled in the art and a number of such materials are available as articles of commerce.

The practice of this invention is illustrated by, but is not limited to, the following examples wherein all parts and percentages are by weight.

EXAMPLE 1

An additive concentrate is formed by blending together the following components: 53.33% zinc di-2-ethylhexyl dithiophosphate (a sample of Elco 108 which meets the various specifications set forth hereinabove); 22.67% ETHYL® antioxidant 735 (a mixture of tertiary butyl phenols containing approximately 85% 2,6-di-tert-butyl phenol, 11% 2,4,6-tri-tert-butyl phenol, 2% 2,4-di-tert-butyl phenol, 2% other phenols); 4.67% 4,4'-bis(tert-nonyl)-1,1'-diphenylamine (Naugalube 438L); 1.33% overbased calcium sulfurized phenate (OLOA 219, a product indicated by the manufacturer, Chevron Chemical Company, to have a TBN (ASTM D2896) of 254, a calcium content of 9.25% and a sulfur content of 3.73%); 1.33% calcium dinonylnaphthalene sulfonate as a 50% solution in light mineral oil (NA-SUL® 729 additive); 6.67% modified imidazoline rust inhibitor (HiTEC® 536 additive, a product indicated by the suppliers thereof, Ethyl Petroleum Additives, Inc, Ethyl Petroleum Additives, Ltd., Ethyl S.A., Ethyl Canada Limited, to have a neutralization number in the range of 51 to 61 mg KOH/g, typically 56; a typical specific gravity of 0.92 to 0.94; a typical viscosity at 100° C. of 36 cSt); 0.4% amine polyglycol condensate nonionic surface active agent (TRITON® CF-32, a product indicated by the manufacturer, Rohm & Haas Company, to be a mixture of 95% active and 5% water having a Brookfield Viscosity @25° C. of 550 cps, a specific gravity @25° C. of 1.03, a pH of 9.5–11, a flash point (TOC) >300° F. and a pour point of 15° F. (−9° C.); 9.60% process oil diluent. The concentrate can be employed in functional fluids such as hydrocarbon based hydraulic fluid at concentrations in the range of about 0.50 to about 1.25%, a preferred treat level being 0.75%.

EXAMPLE 2

An additive concentrate is formed by blending together the following components: 41.76% zinc di-2-ethylhexyl dithiophosphate as used in Example 1; 18.94% ETHYL® antioxidant 735 (a mixture of tertiary butyl phenols containing approximately 85% 2,6-di-tert-butyl phenol, 11% 2,4,6-tri-tert-butyl phenol, 2% 2,4-di-tert-butyl phenol, 2% other phenols); 4.0% 4,4'-bis(tert-nonyl)-1,1'-diphenylamine (Naugalube 438L); 0.82% calcium dinonylnaphthalene sulfonate as a 50% solution in light mineral oil (NA-SUL® 729 additive); 10.0% modified imidazoline rust inhibitor (HiTEC® 536 additive, a product indicated by the suppliers thereof, Ethyl Petroleum Additives, Inc, Ethyl Petroleum Additives, Ltd., Ethyl S.A., Ethyl Canada Limited, to have a neutralization number in the range of 51 to 61 mg KOH/g, typically 56; a typical specific gravity of 0.92 to 0.94; a typical viscosity at 100° C. of 36 cSt); 6.47% sulfurized sperm oil replacement (SUL-PERM 10S, a product indicated by the manufacturer thereof, Keil Chemical Division of Ferro Corporation, to contain 9.5% sulfur and to have the following properties: a viscosity at 100° F. of 2000 SUS, a viscosity at 210° F. of 210 SUS, a specific gravity at 77° F. of 0.9844 and to exhibit an ASTM D130 rating of 1A); 0.35% poly(oxyethylene)-poly(oxypropylene) derivative of ethylene diamine (a product marketed by BASF Corporation as TETRONIC 1501 and as PLURADYNE FL5151, and indicated to have the following typical properties: a molecular weight of 7900, a specific gravity (25°/25° C.) of 1.02, a Brookfield Viscosity of 1170 cps at 25° C., a pour point of −4° C., and a refractive index at 25° C. of 1.4537); and 17.64% process oil diluent. The concentrate can be employed in functional fluids such as hydrocarbon based hydraulic fluid at concentrations in the range of about 0.50 to about 1.25%, a preferred treat level being 0.85%.

EXAMPLE 3

An additive concentrate is formed by blending together the following components: 42.67% zinc di-2-ethylhexyl dithiophosphate as used in Example 1; 28.33% ETHYL® antioxidant 735 (a mixture of tertiary butyl phenols containing approximately 85% 2,6-di-tert-butyl phenol, 11% 2,4,6-tri-tert-butyl phenol, 2% 2,4-di-tert-butyl phenol, 2% other phenols): 5.83% 4,4'-bis(tert-nonyl)-1,1'-diphenylamine (Naugalube 438L); .83% overbased calcium sulfurized phenate (OLOA 219, a product indicated by the manufacturer, Chevron Chemical Company, to have a TBN (ASTM D2896) of 254, a calcium content of 9.25% and a sulfur content of 3.73%); 8.33% modified imidazoline rust inhibitor (HiTEC® 536 additive, a product indicated by the suppliers thereof, Ethyl Petroleum Additives, Inc, Ethyl Petroleum Additives, Ltd., Ethyl S.A., Ethyl Canada Limited, to have a neutralization number in the range of 51 to 61 mg KOH/g, typically 56; a typical specific gravity of 0.92 to 0.94; a typical viscosity at 100° C. of 36 cSt); 0.5% amine polyglycol condensate nonionic surface active agent (TRITON® CF-32, a product indicated by the manufacturer, Rohm & Haas Company, to be a mixture of 95% active and 5% water having a Brookfield Viscosity @25° C. of 550 cps, a specific gravity @25° C. of 1.03, a pH of 9.5–11, a flash point (TOC) >300° F. and a pour point of 15° F. (−9° C.); 0.25% poly(oxyethylene)-poly(oxypropylene) derivative of ethylene diamine (a product marketed by BASF Corporation as TETRONIC 1501 and as PLURADYNE FL5151, and indicated to have the following typical properties: a molecular weight of 7900, a specific gravity (25°/25° C.) of 1.02, a Brookfield Viscosity of 1170 cps at 25° C., a pour point of −4° C., and a refractive index at 25° C. of 1.4537); 3.33% modified imidazoline corrosion inhibitor with a nitrogen content in the range of about 5.5 to about 5.8 and a boiling point of approximately 305° F. (MONAMULSE CI, a product supplied by Mona Industries and indicated by the supplier to have the following typical properties: a specific gravity @25° C. of approximately 0.959, an acid number in the range of 0–2, and an alkali number in the range of 100–120); and 4.93% process oil diluent. The concentrate can be employed in functional fluids such as hydrocarbon based hydraulic fluid at concentrations in the range of about 0.50 to about 1.25%, a preferred treat level being 0.60%.

EXAMPLE 4

An additive concentrate is formed by blending together the following components: 53.33% zinc di-2-ethylhexyl dithiophosphate as used in Example 1; 19.0% ETHYL® antioxidant 735 (a mixture of tertiary butyl phenols containing approximately 85% 2,6-di-tert-butyl phenol, 11% 2,4,6-tri-tert-butyl phenol, 2% 2,4-di-tert-butyl phenol, 2% other phenols): 4.00% 4,4'-bis(tert-nonyl)-1,1'-diphenylamine (Naugalube 438L); 0.8% calcium dinonylnaphthalene sulfonate as a 50% solution in light mineral oil (NA-SUL® 729 additive); 9.96% modified imidazoline rust inhibitor (HiTEC® 536 additive a product indicated by the suppliers thereof, Ethyl Petroleum Additives, Inc, Ethyl Petroleum Additives, Ltd., Ethyl S.A., Ethyl Canada Limited, to have a neutralization number in the range of 51 to 61 mg KOH/g, typically 56; a typical specific gravity of 0.92 to 0.94; and a typical viscosity at 100° C. of 36 cSt); 0.39% amine polyglycol condensate nonionic surface active agent (TRITON® CF-32, a product indicated by the manufacturer, Rohm & Haas Company, to be a mixture of 95% active and 5% water having a Brookfield Viscosity @25° C. of 550 cps, a specific gravity @25° C. of 1.03, a pH of 9.5–11, a flash point (TOC) >300° F. and a pour point of 15° F. (−9° C.); 6.47% sulfurized sperm oil replacement (SUL-PERM 10S, a product indicated by the manufacturer thereof, Keil Chemical Division of Ferro Corporation, to contain 9.5% sulfur and to have the following properties: a viscosity at 100° F. of 2000 SUS, a viscosity at 210° F. of 210 SUS, a specific gravity at 77° F. of 0.9844 and to exhibit an ASTM D130 rating of IA); and 6.05% process oil diluent. The concentrate can be employed in functional fluids such as hydrocarbon based hydraulic fluid at concentrations in the range of about 0.60 to about 1.5%, a preferred treat level being 0.85%.

The oxidative and thermal stability performance that can be achieved using suitable compositions of this invention is illustrated by the results of a series of tests using the Cincinnati Milacron Thermal Stability Test Procedure "A". See Cincinnati Milacron Lubricants Purchase Specification Approved Products Handbook, pages 3-1 to 3-3. Four test samples were formed using a mineral base oil of ISO viscosity grade 46. Each oil sample contained 0.40 wt. % of one of four different zinc dialkyl dithiophosphates together with the remaining additive components set forth in Example 4 above in the relative proportions therein specified. One such sample corresponded to the composition of Example 4, and thus was a composition of this invention ("A"). Each of the remaining three samples was formulated with one of three respective different commercially available zinc dihydrocarbyl dithiophosphates which did not satisfy the specifications set forth hereinabove. Thus these three samples ("B", "C" and "D") were not samples of a composition of this invention.

The results of these comparative tests are summarized in Table 1 below, wherein the appearance ratings are according to a scale of 1 to 10 in which the lower the numerical rating, the better the result. All results shown are the average of 3 runs.

TABLE 1

Results of Cincinnati Milacron "A" Tests

| Property | A | B | C | D |
|---|---|---|---|---|
| Sludge, mg | 30.2 | 79.3 | 68.7 | 62.1 |
| Copper appearance | 4 | 10 | 10 | 10 |
| Copper deposit, mg | 1.9 | 7.7 | 4.2 | 5.2 |
| Copper weight loss, mg | 2.1 | 7.8 | 5.0 | 5.1 |
| Iron appearance | 1 | 2 | 1 | 2 |
| Iron weight loss, mg | 0.2 | 0.4 | 0.3 | 0.3 |
| Viscosity increase, % | 0.9 | 1.2 | 0.9 | 1.3 |
| TAN increase | 0.0 | 0.3 | 0.3 | 0.3 |

In another series of tests conducted in the same manner with the same materials except that the level of zinc dialkyl dithiophosphate in the samples was 0.25 wt. %, and the other components of the formulation were those of Example 3 above and were proportioned as therein set forth. Thus once again "A" was a composition of this invention whereas "B", "C" and "D" were not. Table 2 summarizes the results of these tests.

TABLE 2

Results of Cincinnati Milacron "A" Tests

| Property | A | B | C | D |
|---|---|---|---|---|
| Sludge, mg | 8.6 | 9.0 | 13.9 | 7.2 |
| Copper appearance | 2 | 7 | 3 | 3 |
| Copper deposit, mg | 1.0 | 3.6 | 2.2 | 3.6 |
| Copper weight loss, mg | 1.0 | 4.5 | 2.8 | 4.4 |
| Iron appearance | 1 | 1 | 1 | 1 |
| Iron weight loss, mg | 0.4 | 0.2 | 0.3 | 0.4 |
| Viscosity increase, % | 1.8 | 1.4 | 1.8 | 2.1 |
| TAN increase | 0.0 | −0.1 | 0.0 | 0.0 |

Table 3 summarizes the results of comparative oxidation stability tests conducted using the ASTM D943 oxidation test procedure. The base oil was a mineral oil of ISO viscosity grade 46 from a different supplier than that used in the above tests. The test samples were made up using the same respective compositions as used in the tests reported in Table 1 above. Thus once again "A" represents a composition of this invention and "B", "C" and "D" represent compositions not of this invention.

TABLE 3

Results of ASTM D943 Tests

| Property | A | B | C | D |
|---|---|---|---|---|
| Initial TAN | 0.3 | 0.4 | 0.3 | 0.4 |
| Life, Hours | 2007 | 1268 | 1254 | 1275 |

The additive combinations of this invention can be incorporated in a wide variety of lubricants and functional fluids in effective amounts to provide suitable active ingredient concentrations. The base oils not only can be hydrocarbon oils of lubricating viscosity derived from petroleum (or tar sands, coal, shale, etc.), but also can be natural oils of suitable viscosities such as rapeseed oil, etc., and synthetic oils such as hydrogenated polyolefin oils; poly-α-olefins (e.g., hydrogenated or unhydrogenated α-olefin oligomers such as hydrogenated poly-1-decene); alkyl esters of dicarboxylic acids; complex esters of dicarboxylic acid, polyglycol and alcohol; alkyl esters of carbonic or phosphoric acids; polysilicones; fluorohydrocarbon oils; and mixtures of mineral, natural and/or synthetic oils in any proportion, etc. The term "base oil" for this disclosure includes all the foregoing.

The additive combinations of this invention can thus be used in lubricating oil and functional fluid compositions, such as automotive crankcase lubricating oils, automatic transmission fluids, gear oils, hydraulic oils, cutting oils, etc., in which the base oil of lubricating viscosity is a mineral oil, a synthetic oil a natural oil such as a vegetable oil, or a mixture thereof, e.g. a mixture of a mineral oil and a synthetic oil. Preferably, the compositions of this invention are employed as power transmission fluids, especially automotive or industrial hydraulic fluids.

Suitable mineral oils include those of appropriate viscosity refined from crude oil of any source including Gulf Coast, Midcontinent, Pennsylvania, California, Alaska, Mexico, Africa, Middle East, North Sea and the like. Standard refinery operations may be used in processing the mineral oil. Among the general types of petroleum oils useful in the compositions of this invention are solvent neutrals, bright stocks, cylinder stocks, residual oils, hydrocracked base stocks, paraffin oils including pale oils, and solvent extracted naphthenic oils. Such oils and blends of them are produced by a number of conventional techniques which are widely known by those skilled in the art.

As is noted above, the base oil can consist essentially of or comprise a portion of one or more synthetic oils. Among the suitable synthetic oils are homo- and interpolymers of $C_2$–$C_{12}$ olefins, carboxylic acid esters of both monoalcohols and polyols, polyethers, silicones, polyglycols, silicates, alkylated aromatics, carbonates, thiocarbonates, orthoformates, phosphates and phosphites, borates and halogenated hydrocarbons. Representative of such oils are homo- and interpolymers of $C_2$–$C_{12}$ monoolefinic hydrocarbons, alkylated benzenes (e.g., dodecyl benzenes, didodecyl benzenes, tetradecyl benzenes, dinonyl benzenes, di-(2-ethylhexyl)benzenes, wax-alkylated naphthalenes); and polyphenyls (e.g., biphenyls, terphenyls). Alkylene oxide polymers and interpolymers and derivatives thereof where the terminal hydroxyl groups have been modified by esterification, etherification, etc., constitute another class of synthetic oils. These are exemplified by the oils prepared through polymerization of alkylene oxides such as ethylene oxide or propylene oxide, and the alkyl and aryl ethers of these polyoxyalkylene polymers (e.g., methyl polyisopropylene glycol ether having an average molecular weight of 1000, diphenyl ether of polyethylene glycol having a molecular weight of 500–1000, diethyl ether of polypropylene glycol having a molecular weight of 1000–1500) or mono- and poly-carboxylic esters thereof, for example, the acetic acid ester, mixed $C_3$–$C_6$ fatty acid esters, or the $C_{13}$ Oxo acid diester of tetraethylene glycol.

Another suitable class of synthetic oils comprises the esters of dicarboxylic acids (e.g., phthalic acid, succinic acid, maleic acid, azelaic acid, suberic acid, sebacic acid, fumaric acid, adipic acid, linoleic acid dimer) with a variety of alcohols (e.g., butyl alcohol, hexyl alcohol, dodecyl alcohol, 2-ethylhexyl alcohol, ethylene glycol). Specific examples of these esters include dibutyl adipate, di(2-ethylhexyl) adipate, didodecyl adipate, di(-tridecyl) adipate, di(2-ethylhexyl) sebacate, dilauryl sebacate, di-n-hexyl fumarate, dioctyl sebacate, diisooctyl azelate, diisodecyl azelate, dioctyl phthalate, didecyl phthalate, di(eicosyl) sebacate, the 2-ethylhexyl diester of linoleic acid dimer, and the complex ester formed by reacting one mole of sebacic acid with two moles of tetraethylene glycol and two moles of 2-ethylhexanoic acid.

Other esters which may be used include those made from $C_3$–$C_{18}$ monocarboxylic acids and polyols and polyol ethers such as neopentyl glycol, trimethylolpropane, pentaerythritol and dipentaerythritol. Trimethylol propane tripelargonate, pentaerythritol tetracaproate, the ester formed from trimethylolpropane, caprylic acid and sebacic acid, and the polyesters derived from a $C_4$–$C_{14}$ dicarboxylic acid and one or more aliphatic dihydric $C_3$–$C_{12}$ alcohols such as derived from azelaic acid or sebacic acid and 2,2,4-trimeth-1,6-hexanediol serve as examples.

Silicon-based oils such as the polyalkyl-, polyaryl-, polyalkoxy-, or polyaryloxy-siloxane oils and silicate oils comprise another class of synthetic lubricants (e.g., tetraethyl silicate, tetraisopropyl silicate, tetra-(2-ethylhexyl) silicate, tetra-tert-butylphenyl) silicate, poly(methyl)siloxanes, and poly(met phenyl)siloxanes. Other synthetic lubricating oils include liquid esters of phosphorus-containing acids (e.g., tricresyl phosphate, trioctyl phosphate, triphenyl phosphite, and diethyl ester of decane phosphonic acid.

Also useful as base oils or as components of base oils are hydrogenated or unhydrogenated liquid oligomers of $C_6$–$C_{16}$ α-olefins, such as hydrogenated or unhydrogenated oligomers formed from 1-decene. Methods for the production of such liquid oligomeric 1-alkene hydrocarbons are known and reported in the literature. See for example U.S. Pat. Nos. 3,749,560; 3,763,244; 3,780,128; 4,172,855; 4,218,330; 4,902,846; 4,906,798; 4,910,355; 4,911,758; 4,935,570; 4,950,822; 4,956,513; and 4,981,578. Additionally, hydrogenated 1-alkene oligomers of this type are available as articles of commerce, e.g., under the trade designations ETHYLFLO 162, ETHYLFLO 164, ETHYLFLO 166, ETHYLFLO 168, ETHYLFLO 170, ETHYLFLO 174, and ETHYLFLO 180 poly-α-olefin oils (Ethyl Corporation; Ethyl Canada Limited; Ethyl S.A.). Blends of such materials can also be used in order to adjust the viscometrics of the given base oil. Suitable 1-alkene oligomers are also available from other suppliers. As is well known, hydrogenated oligomers of this type contain little, if any, residual ethylenic unsaturation.

Preferred oligomers are formed by use of a Friedel-Crafts catalyst (especially boron trifluoride promoted with water or a $C_{1-20}$ alkanol) followed by catalytic hydrogenation of the oligomer so formed using procedures such as are described in the foregoing U.S. patents.

Other catalyst systems which can be used to form oligomers of 1-alkene hydrocarbons, which, on hydrogenation, provide suitable oleaginous liquids include Ziegler catalysts such as ethyl aluminum sesquichloride with titanium tetrachloride, aluminum alkyl catalysts, chromium oxide catalysts on silica or alumina supports and a system in which a boron trifluoride catalyst oligomerization is followed by treatment with an organic peroxide.

It is also possible in accordance with this invention to utilize blends of one or more liquid hydrogenated 1-alkene oligomers in combination with other oleaginous materials having suitable viscosities, provided that the resultant blend has suitable compatibility and possesses the physical properties desired.

For some applications, for example use under conditions where oxidative or thermal degradation of the base oil is unlikely to be experienced, unhydrogenated 1-alkene oligomers can be used as the base oil or as a component in a base oil blend.

Likewise, various proprietary synthetic lubricants such as KETJENLUBE synthetic oil of Akzo Chemicals can be employed either as the sole base lubricant or as a component of the base lubricating oil.

Typical natural oils that may be used as base oils or as components of the base oils include castor oil, olive oil, peanut oil, rapeseed oil, corn oil, sesame oil, cottonseed oil, soybean oil, sunflower oil, safflower oil, hemp oil, linseed oil, tung oil, oiticica oil, jojoba oil, meadowfoam oil, and the like. Such oils may be partially or fully hydrogenated, if desired, provided of course that the resultant product possesses the requisite or desired physical properties.

The fact that the base oils used in the compositions of this invention may be composed of (i) one or more mineral oils, (ii) one or more synthetic oils, (iii) one or more natural oils, or (iv) a blend of (i) and (ii), or (i) and (iii), or (ii) and (iii), or (i), (ii) and (iii) does not mean that these various types of oils are necessarily equivalents of each other. Certain types of base oils may be used in certain compositions for the specific properties they possess such as biodegradability, high temperature stability, non-flammability or lack of corrosivity towards specific metals (e.g. silver or cadmium). In other compositions, other types of base oils may be preferred for reasons of availability or low cost. Thus, the skilled artisan will recognize that while the various types of base oils discussed above may be used in the compositions of this invention, they are not necessarily functional equivalents of each other in every instance.

In general, the additives are employed in the base oils in minor amounts sufficient to improve the performance characteristics and properties of the base oil or fluid. The amounts will thus vary in accordance with such factors as the viscosity characteristics of the base oil or fluid employed, the viscosity characteristics desired in the finished product, the service conditions for which the finished product is intended, and the performance characteristics desired in the finished product. However, generally speaking, the following concentrations (weight percent) of the components (active ingredients) in the base oils or fluids are illustrative:

| | General Range | Preferred Range | More Preferred Range | Particularly Preferred Range |
|---|---|---|---|---|
| Component a) | 0.1–5 | 0.2–2 | 0.3–1.4 | 0.35–0.8 |
| Component b) | 0.01–2.5 | 0.05–1.5 | 0.1–1 | 0.15–0.5 |

-continued

| | General Range | Preferred Range | More Preferred Range | Particularly Preferred Range |
|---|---|---|---|---|
| Component c) | 0.001–2 | 0.006–1.5 | 0.01–1 | 0.02–0.5 |
| Component d) | 0–1 | 0.0005–0.5 | 0.001–0.1 | 0.003–0.01 |
| Component e) | 0–2 | 0.01–1.5 | 0.04–1.2 | 0.05–1 |

The additive concentrates of this invention will usually contain up to 90 per cent by weight and preferably from 5 to 70 per cent by weight of one or more inert liquid diluents such as light mineral oil, with the balance being active ingredients such as those referred to hereinabove.

Depending on the use to which the composition is to be put, still other additives can be employed therein. These include dispersants, corrosion inhibitors, defoamants, pour point depressants, extreme pressure additives, lubricity additives, viscosity index improvers, and the like.

In some cases where the base oil is a high sulfur oil (e.g., 0.2 wt. % or more), it can be beneficial to include a small quantity of a fully esterified phosphite ester in the lubricant composition. A preferred material for this use is triphenyl phosphite, used in an amount of up to about 0.05 (preferably 0.01 to 0.03) wt. % based on the total weight of the finished lubricant. For further details, reference should be had to commonly-assigned copending application Ser. No. 825,570 of John M. Taylor (Case EI-6457), filed contemporaneously herewith.

This invention is susceptible to considerable variation in its practice. Thus this invention is not intended to be limited by the specific exemplifications set forth hereinabove. Rather, the subject matter covered is within the spirit and scope of the appended claims and the permissible equivalents thereof.

We claim:

1. An oil-based lubricant or functional fluid composition which comprises a major proportion of at least one base oil of lubrication viscosity, and minor/amounts of:

a) about 0.2 to about 2 wt. % of at least one overbased zinc dialkyl dithiophosphate characterized in that (i) each of the alkyl groups is a primary alkyl group containing from 6 to 10 carbon atoms, (ii) the over based to neutral ratio of said dithiophosphate is 0.96 or above as determined by $^{31}P$ nmr, (iii) the integrated $^{31}P$ nmr spectrum of said dithiophosphate shows less than about 0.25 area percent phosphorus at about 80 ppm, (iv) the integrated $^{31}P$ nmr spectrum of said dithiophosphate shows essentially no phosphate species at about 5 to about 15 ppm, and (v) said dithiophosphate exhibits a copper weight loss in ASTM Test Method D2619 of 0.70 maximum;

b) at least one hindered phenolic antioxidant or at least one aromatic secondary amine antioxidant; and c) at least one overbased alkaline earth metal sulfurized alkyl phenate having a TBN as determined by ASTM Test Method D2896 of at least 200 or at least one alkaline earth metal alkyl aromatic sulfonate.

2. A composition according to claim 1 wherein said zinc dithiophosphate is still further characterized in that the integrated $^{31}P$ nmr spectrum of said dithiophosphate shows essentially no phosphorus species at about 95 to about 98 ppm.

3. A composition according to claim 1 wherein said zinc dithiophosphate is zinc di-(2-ethyl-1-hexyl) dithiophosphate.

4. A composition according to claim 3 wherein said zinc di-(2-ethyl-1-hexyl) dithiophosphate is still further characterized in that the integrated $^{31}P$ nmr spectrum thereof shows essentially no phosphorus species at about 95 to about 98 ppm.

5. A composition according to claim 1 further comprising a minor amount of (i) at least one demulsifying agent or (ii) at least one antirust additive, or a combination of (i) and (ii).

6. A composition according to claim 1 wherein there are present therein:

a) about 0.2 to about 1 wt. % of said zinc dithiophosphate;

b) about 0.05 to about 1.5 wt. % of a combination of (i) at least one oil-soluble hindered phenolic antioxidant and (ii) at least one oil-soluble aromatic secondary amine antioxidant in proportions such that there are about 3 to about 14 parts by weight of said phenolic antioxidant per part by weight of said amine antioxidant; and c) about 0.006 to about 1.5 wt. % of a combination of (i) at least one said overbased alkaline earth metal sulfurized alkyl phenate and (ii) at least one said alkaline earth metal alkyl aromatic sulfonate in proportions such that there are about 3 to about 3.5 parts by weight of said phenate per part by weight of said sulfonate.

7. A composition according to claim 6 further comprising:

d) about 0.01 to about 0.02 wt. % of at least one demulsifying agent; or e) about 0.03 to about 0.08 wt. % of at least one antirust additive; or a combination of said d) and e).

8. A composition according to claim 6 wherein said zinc dithiophosphate is zinc di-(2-ethyl-1-hexyl) dithiophosphate, wherein said phenolic antioxidant is a mixture of tertiary butylated phenols containing at least about 75 wt. % of 2,6-di-tert-butylphenol, wherein said aromatic secondary amine is a diphenyl amine having at least one alkyl substituent on at least one of its phenyl groups, wherein said phenate is overbased calcium sulfurized alkyl phenate, and said sulfonate is a calcium alkyl aromatic sulfonate.

9. A composition according to claim 8 wherein said zinc di-(2-ethyl-1-hexyl) dithiophosphate is still further characterized in that the integrated $^{31}P$ nmr spectrum thereof shows essentially no phosphorus species at about 95 to about 98 ppm; wherein said mixture of tertiary butylated phenols contains at least about 85 wt. % of 2,6-di-tert-butylphenol; wherein said diphenylamine is represented by the formula

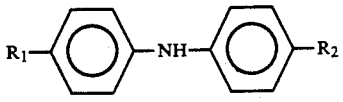

wherein $R_1$ is an alkyl group having 8 to 12 carbon atoms, and $R_2$ is a hydrogen atom or an alkyl group having 8 to 12 carbon atoms; wherein said overbased calcium sulfurized alkyl phenate has a TBN of at least about 250; and wherein said sulfonate is a calcium alkyl naphthalene sulfonate.

10. A composition according to claim 9 wherein there are additionally present therein about 0.0005 to about 0.1 wt. % of amine glycol condensate nonionic surface active agent as demulsifying agent and about 0.01 to about 1.5 wt. % of modified imidazoline rust inhibitor, and wherein said diphenylamine is 4,4'-bis(tert-nonyl)-1,1'-diphenylamine.

11. An additive concentrate suitable for addition to oil-based lubricants and functional fluid compositions, said additive concentrate comprising a minor amount of liquid inert diluent and a major amount of the following combination of components:

a) at least one overbased zinc dialkyl dithiophosphate characterized in that (i) each of the alkyl groups is a primary alkyl group containing from 6 to 10 carbon atoms,.(ii) the overbased to neutral ratio of said dithiophosphate is 0.96 or above as determined by $^{31}P$ nmr, (iii) the integrated $^{31}P$ nmr spectrum of said dithiophosphate shows less than about 0.25 area percent phosphorus at about 80 ppm, (iv) the integrated $^{31}P$ nmr spectrum of said dithiophosphate shows essentially no phosphate species at about 5 to about 15 ppm, and (v) said dithiophosphate exhibits a copper weight loss in ASTM Test Method D2619 of 0.70 maximum;

b) at least one hindered phenolic antioxidant or at least one aromatic secondary amine antioxidant; and c) at least one overbased alkaline earth metal sulfurized alkyl phenate having a TBN as determined by ASTM Test Method D2896 of at least 200 or at least one alkaline earth metal alkyl aromatic sulfonate.

12. A composition according to claim 11 wherein said zinc dithiophosphate is still further characterized in that the integrated $^{31}P$ nmr spectrum of said dithiophosphate shows essentially no phosphorus species at about 95 to about 98 ppm.

13. A composition according to claim 11 wherein said zinc dithiophosphate is zinc di-(2-ethyl-1-hexyl) dithiophosphate.

14. A composition according to claim 13 wherein said zinc di-(2-ethyl-1-hexyl) dithiophosphate is still further characterized in that the integrated $^{31}P$ nmr spectrum thereof shows essentially no phosphorus species at about 95 to about 98 ppm.

15. A composition according to claim 11 further comprising a minor amount of (i) at least one demulsifying agent or (ii) at least one antirust additive, or a combination of (i) and (ii).

16. A composition according to claim 11 wherein there are present therein:

a) about 25 to about 70 wt. % of said zinc dithiophosphate;

b) about 12 to about 48 wt. % of a combination of (i) at least one oil-soluble hindered phenolic antioxidant and (ii) at least one oil-soluble aromatic secondary amine antioxidant in proportions such that there are about 3 to about 14 parts by weight of said phenolic antioxidant per part by weight of said amine antioxidant; and c) about 2.3 to about 9.5 wt. % of a combination of (i) at least one said overbased alkaline earth metal sulfurized alkyl phenate and (ii) at least one said alkaline earth metal alkyl aromatic sulfonate in proportions such that there are about 3 to about 3.5 parts by weight of said phenate per part by weight of said sulfonate.

17. A composition according to claim 16 further comprising:

d) about 1.2 to about 1.8 wt. % of at least one demulsifying agent; or e) about 7 to about 10 wt. % of at least one antirust additive; or a combination of said d) and e).

18. A composition according to claim 16 wherein said zinc dithiophosphate is zinc di-(2-ethyl-1-hexyl) dithiophosphate, wherein said phenolic antioxidant is a mixture of tertiary butylated phenols containing at least about 75 wt. % of 2,6-di-tert-butylphenol, wherein said aromatic secondary amine is a diphenyl amine having at least one alkyl substituent on at least one of its phenyl groups, wherein said phenate is overbased calcium sulfurized alkyl phenate, and said sulfonate is a calcium alkyl aromatic sulfonate.

19. A composition according to claim 18 wherein said zinc di-(2-ethyl-1-hexyl) dithiophosphate is still further characterized in that the integrated $^{31}P$ nmr spectrum thereof shows essentially no phosphorus species at about 95 to about 98 ppm; wherein said mixture of tertiary butylated phenols contains at least about 85 wt. % of 2,6-di-tert-butylphenol; wherein said diphenylamine is represented by the formula

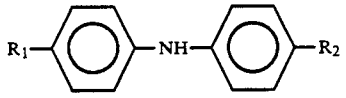

wherein $R_1$ is an alkyl group having 8 to 12 carbon atoms, and $R_2$ is a hydrogen atom or an alkyl group having 8 to 12 carbon atoms; wherein said overbased calcium sulfurized alkyl phenate has a TBN of at least about 250; and wherein said sulfonate is a calcium alkyl naphthalene sulfonate.

20. A composition according to claim 19 wherein there are additionally present therein about 0.05 to about 1 wt. % of amine glycol condensate nonionic surface active agent as demulsifying agent and about 1 to about 15 wt: % of modified imidazoline rust inhibitor, and wherein said diphenylamine is 4,4'-bis(tert-nonyl)-1,1'-diphenylamine.

21. An oil-based lubricant or functional fluid composition which comprises a major portion of at least one base oil of lubrication viscosity and:

(a) about 0.2 to about 2 wt. % of at least one overbased zinc dialkyl dithiophosphate characterized in that (i) each of the alkyl groups is primary alkyl group containing from 6 to 10 carbon atoms, (ii) the overbased to neutral ratio of said dithiophosphate is 0.96 or above as determined by $^{31}P$ nmr, (iii) the integrated $^{31}P$ nmr spectrum of said dithiophosphate shows less than about 0.25 area percent phosphorus at about 80 ppm, (iv) the integrated $^{31}P$ nmr spectrum of said dithiophosphate shows essentially no phosphate species at about 5 to about 15 ppm, and (v) said dithiophosphate exhibits a copper weight loss in ASTM Test Method D2619 of 0.70 maximum;

(b) about 0.01 to about 2.5 wt. % of a combination of (i) at least one oil-soluble hindered phenolic antioxidant and (ii) at least one oil-soluble aromatic secondary amine antioxidant in proportions such that there are about 3 to 14 parts by weight of said phenolic antioxidant per part by weight of said amine antioxidant; and (c) about 0.001 to about 2.0 wt. % of a combination of (i) at least one said overbased alkaline earth metal sulfurized alkyl phenate and (ii) at least one said alkaline earth metal alkyl aromatic sulfonate in proportions such that there are about 3 to about 3.5 pats by weight of said phenate per part by weight of said sulfonate.

22. A composition according to claim 21 wherein said zinc dithiophosphate is zinc di-(2-ethyl-1-hexyl) dithiophosphate, wherein said phenolic antioxidant is a mixture of tertiary butylated phenols containing at least about 75 wt. % of 2,6-di-tert-butylphenol, wherein said aromatic secondary amine is a diphenyl amine having at least one alkyl substituent on at least one of its phenyl groups, wherein said phenate is overbased calcium sulfurized alkyl phenate, and said sulfonate is a calcium alkyl aromatic sulfonate.

23. A composition according to claim 21 wherein said zinc di-(2-ethyl-1-hexyl) dithiophosphate is still further characterized in that the integrated $^{31}P$ nmr spectrum thereof shows essentially no phosphorus species at about 95 to about 98 ppm; wherein said mixture of tertiary butylated phenols contains at least about 85 wt. % of 2,6-di-tert-butylphenol; wherein said diphenylamine is represented by the formula

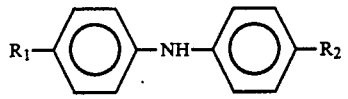

wherein $R_1$ is an alkyl group having 8 to 12 carbon atoms, and $R_2$ is a hydrogen atom or an alkyl group having 8 to 12 carbon atoms; wherein said overbased calcium sulfurized alkyl phenate has a TBN of at least about 250; and wherein said sulfonate is a calcium alkyl naphthalene sulfonate.

24. An additive concentrate suitable for addition to oil-based lubricants and functional fluid compositions, said additive concentrate comprising a minor amount of liquid inert diluent and:

(a) about 25 to about 70% of at least one overbased zinc dialkyl dithiophosphate characterized in that (i) each of the alkyl groups is primary alkyl group containing from 6 to 10 carbon atoms, (ii) the overbased to neutral ratio of said dithiophosphate is 0.96 or above as determined by $^{31}P$ nmr, (iii) the integrated $^{31}P$ nmr spectrum of said dithiophosphate shows less than about 0.25 area percent phosphorus at about 80 ppm, (iv) the integrated $^{31}P$ nmr spectrum of said dithiophosphate shows essentially no phosphate species at about 5 to 15 ppm, and (v) said dithiophosphate exhibits a copper weight loss in ASTM Test Method D2619 of 0.70 maximum;

(b) about 12 to about 48 wt. % of a combination of (i) at least one oil-soluble hindered phenolic antioxidant and (ii) at least one oil-soluble aromatic secondary amine antioxidant in proportions such that there are about 3 to 14 parts by weight of said phenolic antioxidant per part by weight of said amine antioxidant; and (c) about 2.3 to about 9.5 wt. % of a combination of (i) at least one said overbased alkaline earth metal sulfurized alkyl phenate and (ii) at least one said alkaline earth metal alkyl aromatic sulfonate in proportions such that there are about 3 to about 3.5 pats by weight of said phenate per part by weight of said sulfonate.

25. A composition according to claim 24 further comprising:

(d) about 1.2 to about 1.8 wt. % of at least one demulsifying agent; or (e) about 7 to about 10 wt. % of at last one antirust additive; or a combination of said (d) and (e).

* * * * *